US011728102B2

(12) United States Patent
Vucic

(10) Patent No.: US 11,728,102 B2
(45) Date of Patent: Aug. 15, 2023

(54) SWITCH ASSEMBLY, CONTROL METHOD OF SWITCH ASSEMBLY AND POWER TOOL

(71) Applicant: Globe (Jiangsu) Co., Ltd., Changzhou (CN)

(72) Inventor: Goran Vucic, Jönköping (SE)

(73) Assignee: Globe (Jiangsu) Co., Ltd., Changzhou (CN)

( * ) Notice: Subject to any disclaimer, the term of this patent is extended or adjusted under 35 U.S.C. 154(b) by 0 days.

(21) Appl. No.: 17/367,632

(22) Filed: Jul. 6, 2021

(65) Prior Publication Data

US 2022/0020542 A1 Jan. 20, 2022

(30) Foreign Application Priority Data

Jul. 20, 2020 (CN) ..... 202010701627.5

(51) Int. Cl.
*H01H 9/06* (2006.01)
*H01H 9/20* (2006.01)
*H01H 13/08* (2006.01)

(52) U.S. Cl.
CPC ..... *H01H 9/06* (2013.01); *H01H 9/20* (2013.01); *H01H 13/08* (2013.01); *H01H 2009/066* (2013.01); *H01H 2231/048* (2013.01)

(58) Field of Classification Search
None
See application file for complete search history.

(56) References Cited

U.S. PATENT DOCUMENTS 3,873,796 A * 3/1975 Worobec, Jr. ..... H01H 9/06 200/332.2
4,122,320 A * 10/1978 Edgell ..... H01H 9/06 200/43.17
4,219,714 A * 8/1980 Suzuki ..... H01H 13/62 200/43.17
4,879,438 A * 11/1989 Winchester ..... H01H 9/06 310/50
5,577,600 A * 11/1996 Schoene ..... H01H 3/20 200/321
6,469,269 B1 * 10/2002 Jong ..... H01H 9/06 200/332.2
2002/0139654 A1 10/2002 Jong
2009/0229131 A1 * 9/2009 Tomiyama ..... A01D 34/90 30/276
2016/0322183 A1 11/2016 Vogel

* cited by examiner

*Primary Examiner* — Felix O Figueroa

(57) ABSTRACT

A switch assembly, a switch assembly starting method and a power tool are provided. The switch assembly includes a housing, a main control switch accommodated in the housing, a locking switch and a trigger switch arranged on the housing. An end of the trigger switch is accommodated in the housing and is in contact with the main control switch. An end of the locking switch is in contact with the trigger switch. The locking switch has a locking position and a releasing position, when the locking switch is in the locking position, the locking switch limits the trigger switch in a locked state, and the main control switch cannot be started; when the locking switch is in the releasing position, the locking switch is positioned beside the trigger switch and limits are removed, the trigger switch is in the release state, and the main control switch can be started.

14 Claims, 9 Drawing Sheets

SWITCH ASSEMBLY, CONTROL METHOD OF SWITCH ASSEMBLY AND POWER TOOL

CROSS REFERENCE TO RELATED APPLICATION

The present application claims the priority of the Chinese patent applications: serial No. 202010701627.5, filed on Jul. 20, 2020; the disclosures of which is hereby incorporated by reference in it entirely.

TECHNICAL FIELD

The disclosure relates to a switch assembly, a control method of the switch assembly and a power tool, belonging to the field of garden tools.

BACKGROUND

At present, power tools usually have a switch on the handle gripped by the user. However, when the power tool is used, it occurs that the switch may be pressed unintentionally, causing the power tool to start under abnormal conditions when the user only needs to hold it instead of using it, so that dangerous situations occur, and a safety switch needs to be arranged in a conventional switch assembly which can prevent accidental actuation of the switch assembly without the user having to work with the tool.

The conventional starting switch is arranged below the handle and faces downwards, when the power tool is used, the power tool can be started by pressing the starting switch upwards while holding the handle, and the existing safety switch is mainly of a linkage type, that is, if the starting switch needs to be activated, the safety switch needs to be firstly pressed, toggled or rotated, at the moment, the locking of the safety switch to the starting switch is released, and then a user can activate the starting switch to start the tool. The switch assembly designed on the basis of the above technology is widely applied to the field of power tools, wherein the gripping type switch assembly is most common, the safety switches of the switch assembly are arranged on the opposite upper portion of the handle starting switch and are arranged upwards, when a user uses the handle of the tool, the safety switch can be pressed and then the starting switch can be pressed, therefore, the gripping type switch is simple in structure and convenient to use, and the gripping type switch assembly is widely applied to the field of power tools.

However, the use of the above-described gripping type switch assembly has the disadvantage that the actuation of the safety switch and the starting switch cannot be distinguished significantly, which leads to the occurrence of dangerous situations due to the erroneous actuation of the starting switch, and the potential unsafe factors of such gripping type switch assemblies limit their future use on tools in the case of new tool use safety regulations.

In view of this, there is a need for improvements to existing safety switches to address the above problems.

SUMMARY

This disclosure provides a switch assembly which is in a locked state in a non-use state without being inadvertently depressed to cause abnormal activation.

The disclosure provides a switch assembly which comprises a housing, a main control switch accommodated in the housing, a locking switch and a trigger switch, wherein the locking switch and the trigger switch are arranged on the housing, one end of the trigger switch is exposed outside the housing, the other end of the trigger switch is accommodated in the housing and is in contact with the main control switch, one end of the locking switch is exposed outside the housing, and the other end of the locking switch is in contact with the trigger switch. The locking switch is provided with a locking position and a releasing position, when the locking switch is in the locking position, the locking switch is opposite to the trigger switch and limits the action of the trigger switch, the trigger switch is in a locked state, and the main control switch cannot be started; when the locking switch is located at a releasing position, the locking switch is located beside the trigger switch and limits are removed, the trigger switch is in a release state, and the main control switch can be started.

As a further improvement of the disclosure, the trigger switch comprises a contact portion contacted with the main control switch and a holding portion exposed outside the housing, the locking switch comprises a pressing portion exposed outside the housing and an abutting portion contacted with the trigger switch, and when the locking switch is in a locking position, the abutting portion abuts against the inner side wall of the holding portion; when the locking switch is located at the releasing position, the abutting portion is shifted to the side of the holding portion and propped is released, and after the holding portion is operated, the contact portion triggers the main control switch, so that the main control switch is started.

As a further improvement of the disclosure, the holding portion is internally provided with an accommodating cavity, and in a locked state, the abutting portion is in contact with the top wall of the holding portion; and in a release state, the abutting portion is positioned above the accommodating cavity.

As a further improvement of the disclosure, the locking switch further comprises a rotating portion connecting the pressing portion and the abutting portion, the rotating portion is mounted on the housing and can be offset and rotated relative to the housing, and when the pressing portion is pressed, the abutting portion rotates synchronously.

As a further improvement of the disclosure, a first elastic piece and a second elastic piece which are used for driving the locking switch to reset are arranged in the housing, one end of the first elastic piece is abutted against the inner side wall of the housing, the other end of the first elastic piece is abutted against the rotating portion, when the locking switch deviates relative to the housing, the first elastic piece deforms, and the abutting portion moves to the accommodating cavity; the second elastic piece is sleeved on the rotating portion, one end of the second elastic piece is abutted against the inner side wall of the housing, the other end of the second elastic piece is fixed with the pressing portion, when the pressing portion is pressed, the second elastic piece deforms, and the abutting portion enters the accommodating cavity and synchronously rotates in the accommodating cavity.

As a further improvement of the disclosure, the first elastic piece and the second elastic piece are respectively arranged on two sides of the rotating portion, limiting blocks for limiting and fixing the first elastic piece and the second elastic piece are arranged on two sides of the rotating portion, a fixing block is formed on the pressing portion, and the fixing block is arranged in an inverted L shape to form a fixing cavity between the fixing block and the pressing portion; and the other end of the second elastic piece is limited and accommodated in the fixing cavity.

As a further improvement of the disclosure, the trigger switch further comprises a connecting portion for connecting the contact portion and the holding portion, wherein the connecting portion is installed on the housing and can rotate relative to the housing, so that when the holding portion is operated, the contact portion is synchronously driven to trigger the main control switch, and the main control switch is started.

As a further improvement of the disclosure, the main control switch is arranged in a pressing mode and comprises a body portion and a telescopic arm connected with the body portion, and the contact portion of the trigger switch is positioned above the telescopic arm so as to start the main control switch when the contact portion presses the telescopic arm downwards.

The disclosure aims to provide a method for starting a switch assembly, so that the switch assembly cannot be started in a non-use state, and abnormal starting caused by unintentional pressing is avoided.

The disclosure provides a method for starting the switch assembly, which mainly comprises the following steps:

toggling the locking switch towards one side, so that the locking switch deviates relative to the housing, the locking switch moves from a relative position of the trigger switch to a side position, the limit between the locking switch and the trigger switch is released, and the locking switch is located at a releasing position;

operating the locking switch to enable the locking switch to rotate relative to the housing;

operating a first end of the trigger switch to enable the trigger switch to rotate relative to the housing until a second end of the trigger switch triggers the main control switch, and the main control switch is started.

The disclosure aims to provide a power tool in which a switch assembly of the power tool is locked in a non-use state without being inadvertently pressed to cause abnormal activation.

The disclosure provides a power tool comprising a motor and a switch assembly for controlling activation or deactivation of the motor;

the switch assembly comprises:

a housing;

a main control switch accommodated in the housing;

a trigger switch arranged on the housing, wherein one end of the trigger switch is exposed outside the housing, and the other end of the trigger switch is accommodated in the housing and is in contact with the main control switch; and a locking switch arranged on the housing, wherein one end of the locking switch is exposed outside the housing, and the other end of the locking switch is in contact with the trigger switch, the locking switch is provided with a locking position and a releasing position, when the locking switch is in the locking position, the locking switch is opposite to the trigger switch and limits the action of the trigger switch, the trigger switch is in a locked state, and the main control switch cannot be started, and when the locking switch is located at the releasing position, the locking switch is located beside the trigger switch and limits are removed, the trigger switch is in a release state, and the main control switch can be started.

The beneficial effects of the disclosure are: under the non-use state, the locking switch is located at the locking position and the trigger switch is in the locking state, by the mutual abutting of the trigger switch and the locking switch, and at the moment, the main control switch cannot be started; during normal starting, the locking switch is firstly biased towards one side until the locking switch and the trigger switch are released from abutting, and then the main control switch can be started by respectively pressing the locking switch and the trigger switch; compared with the prior art, the switch assembly is not only simple in structure and convenient to operate, but also the switch assembly is always in the locked state in the non-use state, and will not cause abnormal activation due to unintentional pressing, and has a higher safety factor.

DETAILED DESCRIPTION

In order to make objects, aspects, and advantages of the disclosure more apparent, the disclosure will describe in detail with the drawings and specific embodiment.

The disclosure provides a power tool, which can be a hedge trimmer, an electric saw, a blower, a chain saw or a string trimmer, or other types of hand-held power tools.

Figure 1:
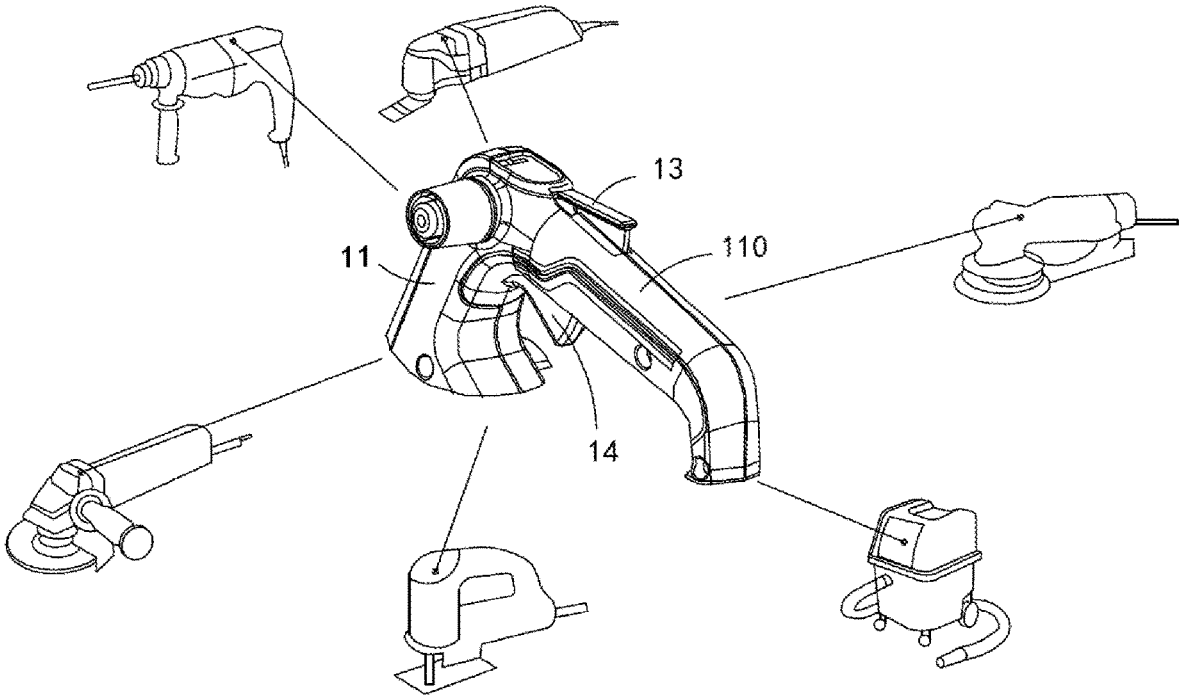
FIG. 1 is a schematic diagram of some power tools to which the switch assembly is applied of the disclosure.

In FIG. 1, these power tools are equipment with the switch assembly 10 of the disclosure. The switch assembly 10 is provided in the form of a gripped handle for operation by a user. Since there are many types of power tools that can be applied, the specific structure of the power tool is not limited herein, and the specific structure of the switch assembly 10 and the control method will be described in detail in the following description.

Figure 2:
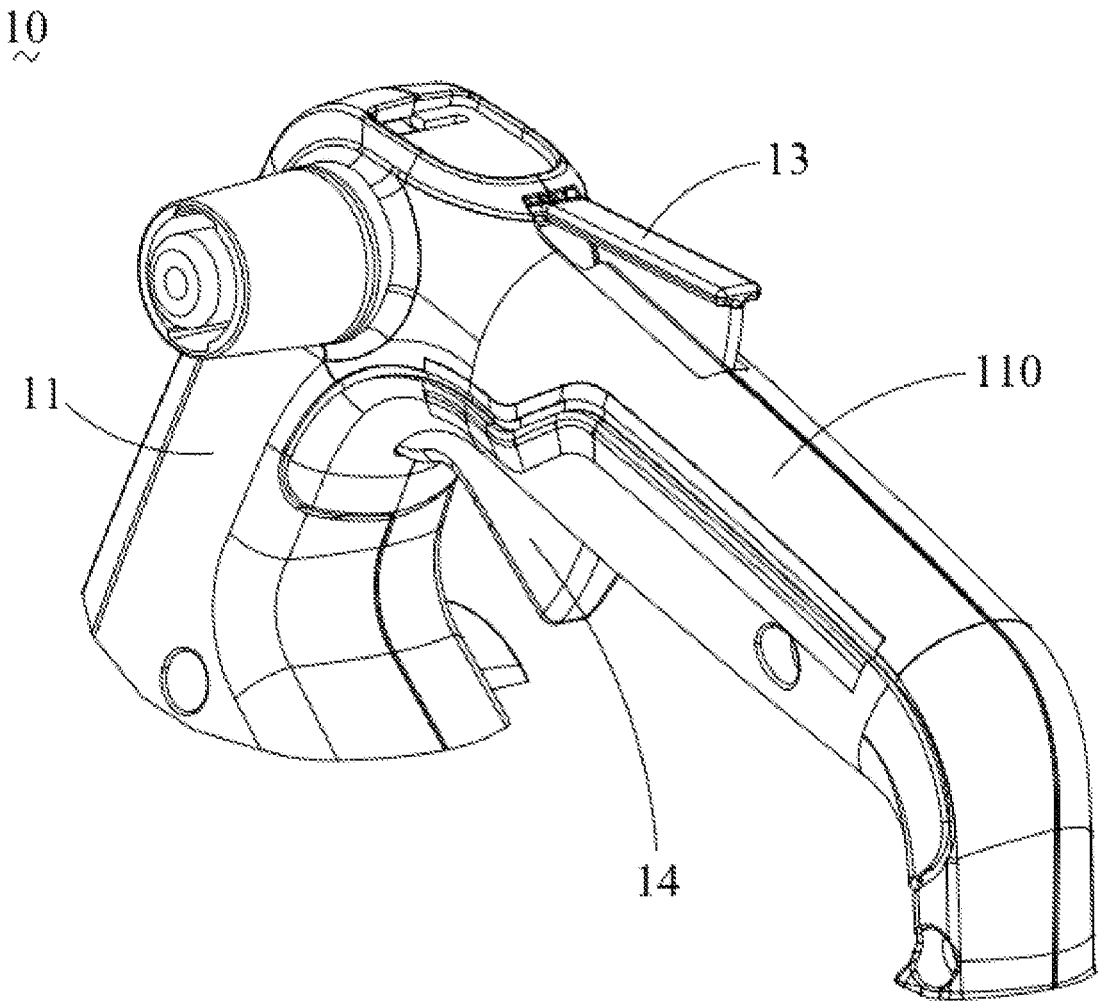
FIG. 2 is a perspective view of the switch assembly of the disclosure.
Figure 3:
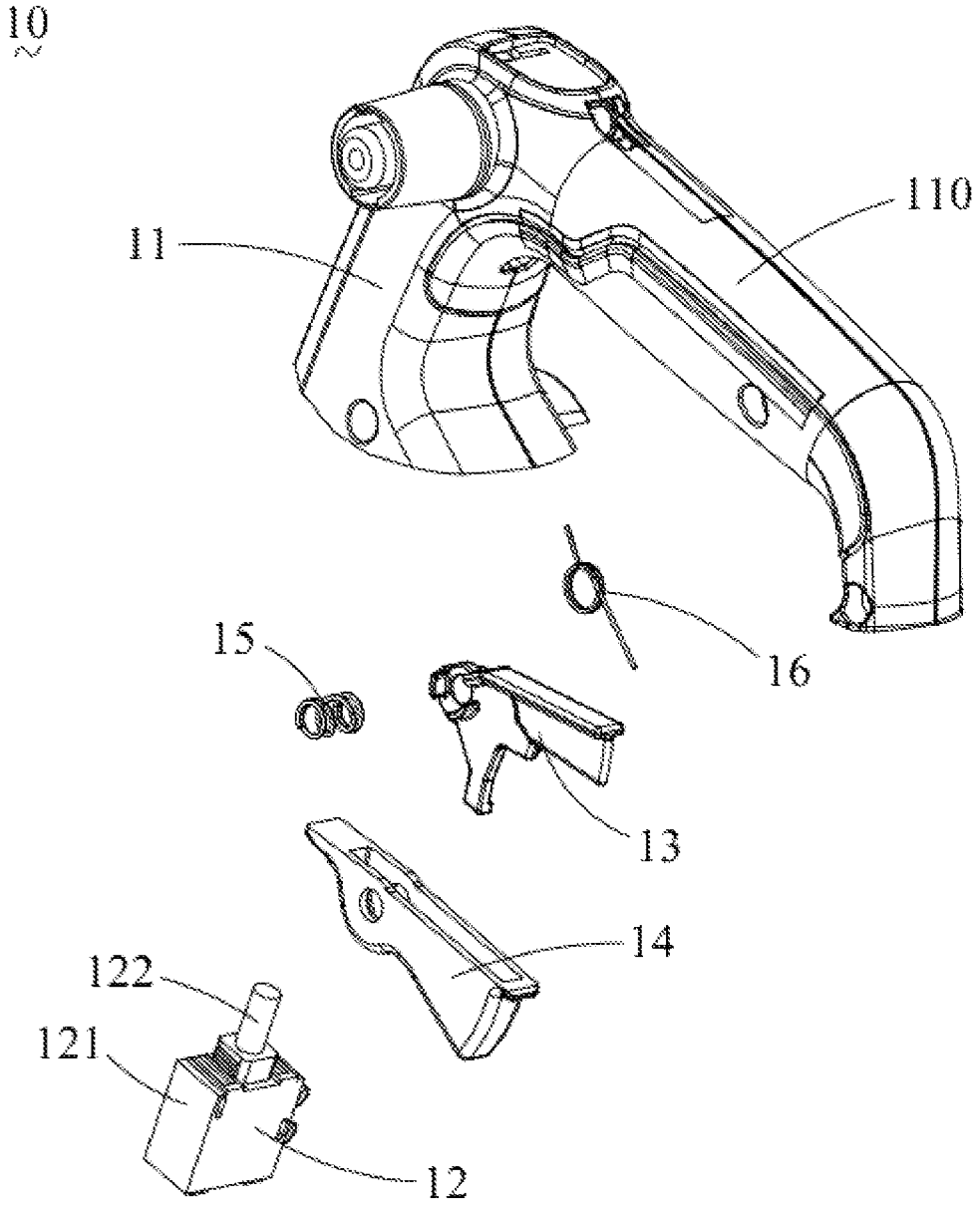
FIG. 3 is an exploded view of the switch assembly shown in FIG. 2.
Figure 4:
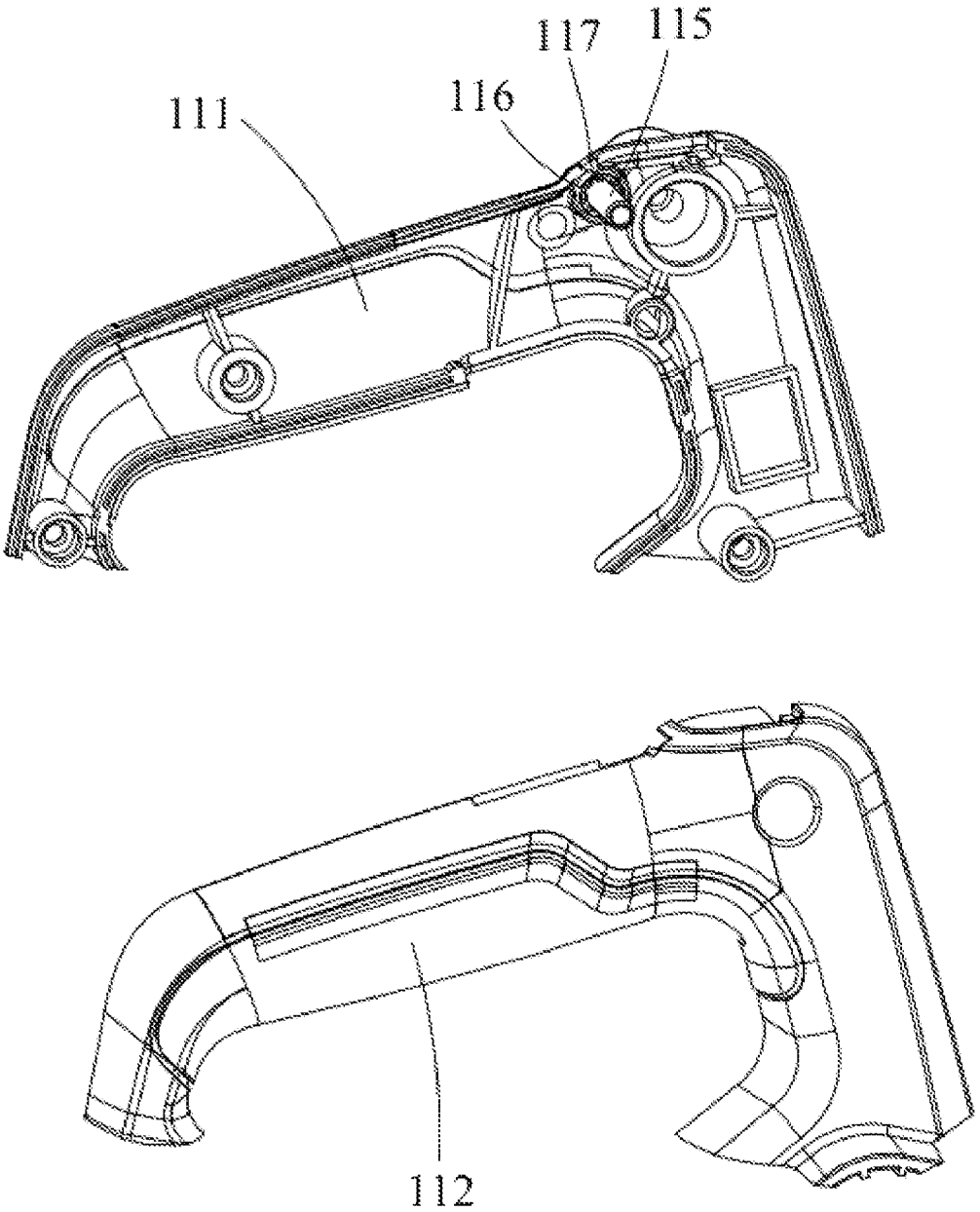
FIG. 4 is an exploded view of the housing in FIG. 3.
Figure 5:
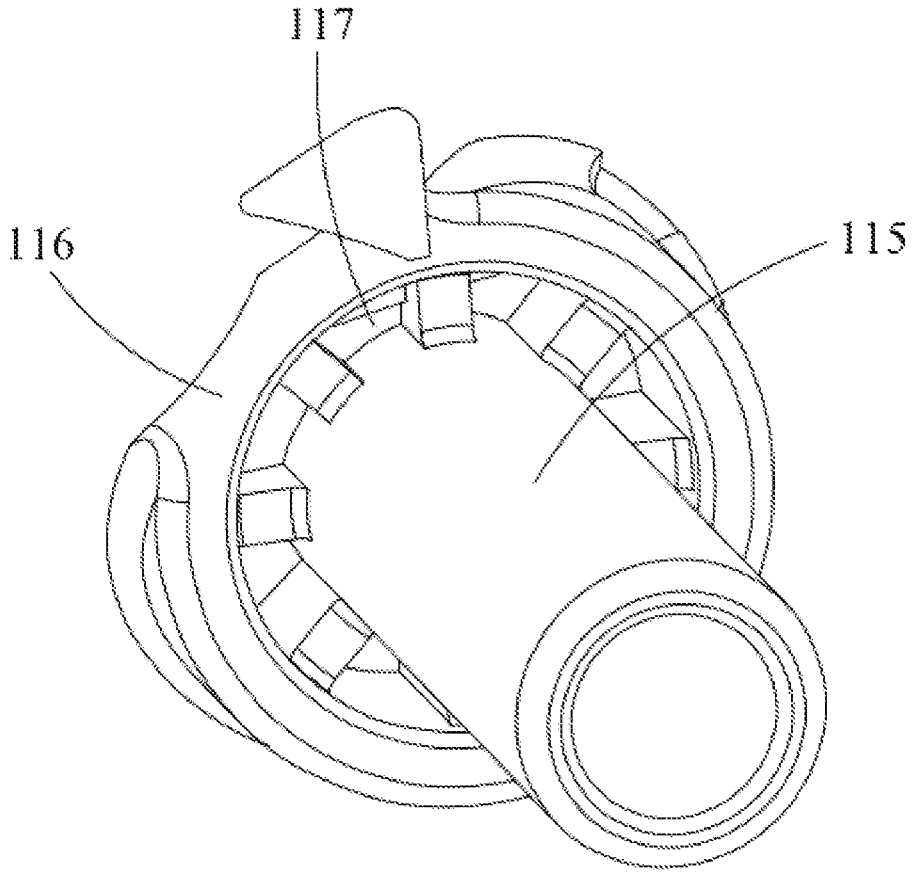
FIG. 5 is an enlarged view of the position of the first inserting piece in FIG. 4.

As shown in FIG. 2 and FIG. 3, the switch assembly 10 comprises a housing 11, a main control switch 12 accommodated in the housing 11, and a locking switch 13 and a trigger switch 14 mounted on the housing 11, wherein one end of the locking switch 13 is exposed outside the housing 11, the other end of the locking switch 13 is in contact (propped against) with the trigger switch 14. And one end of the trigger switch 14 is also exposed outside the housing 11, the other end of the trigger switch 14 is accommodated in the housing 11 and is in contact with the main control switch 12. Moreover, both the locking switch 13 and the trigger switch 14 are push-type triggers, mainly for cooperation with each other, to trigger the main control switch 12, to activate the main control switch 12, and further to control activation or deactivation of a motor (not shown).

As shown in FIGS. 2-3 and 4-6, the housing 11 includes a first housing 111 and a second housing 112 assembled and fixed to each other in the left-right direction, and the main control switch 12 is accommodated in an accommodating space (not numbered) defined by the first housing 111 and the second housing 112. A fixing portion 113 is arranged on the inner side wall of the second housing 112, an accommodating groove 114 communicated with an accommodating space is formed in the fixing portion 113, and the main control switch 12 is accommodated in the accommodating groove 114. In the present embodiment, the first housing 111 and the second housing 112 are locked and fixed to each other by bolts and nuts, but should not be limited thereto.

A first inserting piece 115 and a limiting piece 116 arranged around the first inserting piece 115 are arranged on the inner side wall of the first housing 111, and the first inserting piece 115 is arranged close to the top of the first housing 111 and used for installing the locking switch 13; the limiting piece 116 is spaced from the first inserting piece 115 to form a spacing cavity 117 between the first inserting piece 115 and the limiting piece 116. The inner side wall of the second housing 112 is provided with a second inserting piece 118 disposed near the middle of the second housing 112 for mounting the trigger switch 14. In the present disclosure, the first inserting piece 115 and the second inserting piece 118 are arranged in a cylindrical shape.

The first housing 111 and the second housing 112 are assembled to form a handle 110, the locking switch 13 is positioned at the top of the handle 110 and partly protrudes out of the handle 110, the trigger switch 14 is positioned at the bottom of the handle 110 and partly protrudes out of the handle 110, when the switch assembly 10 is started, the handle 110 is directly held, and the trigger switch 14 is pressed upwards by an index finger while the locking switch 13 is pressed downwards; the starting of the main control switch 12 can be realized, and the operation is simple and convenient.

As shown in FIG. 3, the main control switch 12 is provided in a pressing type configuration and includes a body portion 121 and a telescopic arm 122 connected to the body portion 121, the telescopic arm 122 being elastically provided so as to be capable of self-resetting after releasing the press. In this disclosure, the main control switch 12 is a micro switch, and one end of the trigger switch 14 is positioned above the telescopic arm 122, so that the telescopic arm 122 is triggered (pressed) by the trigger switch 14, and the main control switch 12 is started.

Figure 6:
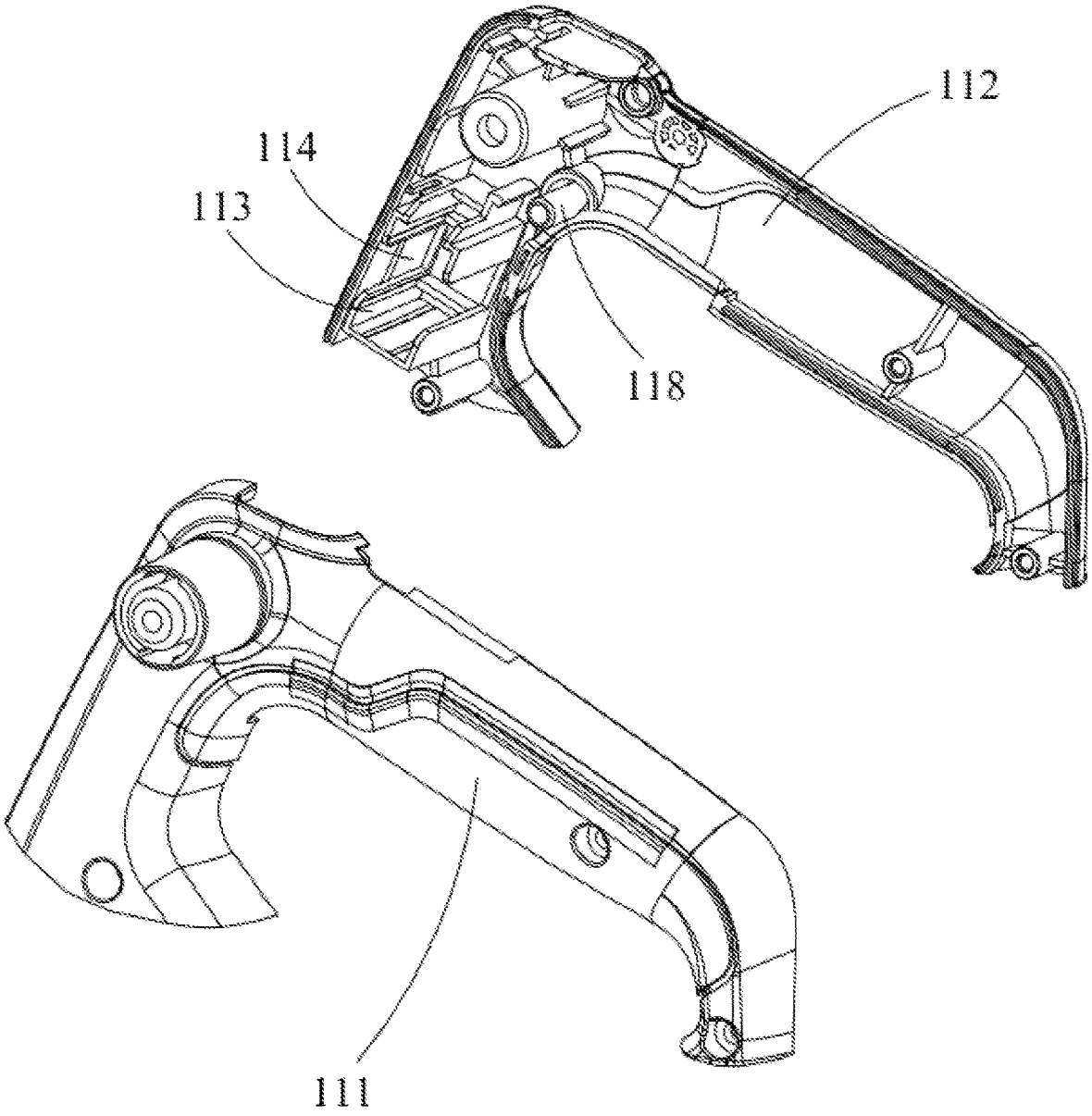
FIG. 6 is another perspective exploded view of the housing in FIG. 3.
Figure 7:
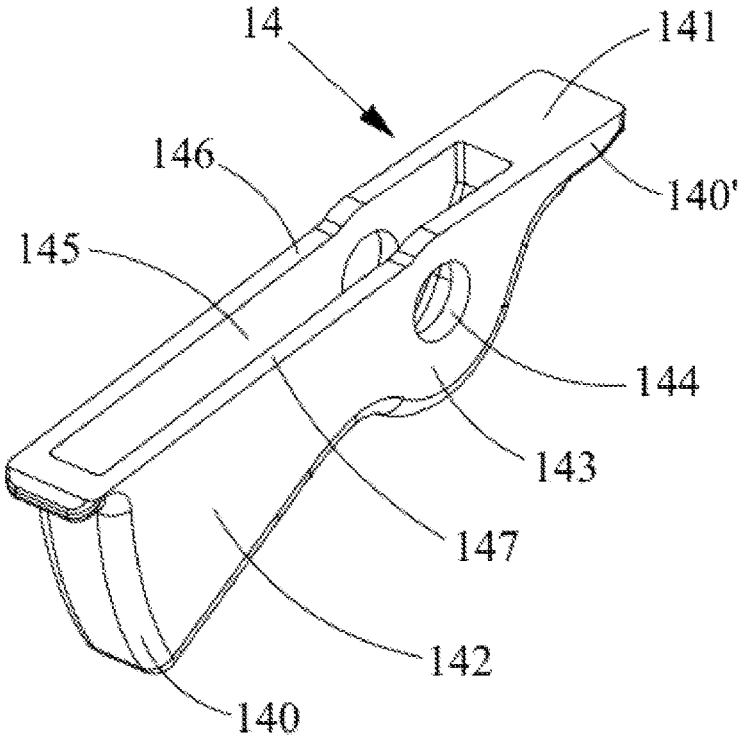
FIG. 7 is a perspective view of the trigger switch in FIG. 3.
Figure 8:
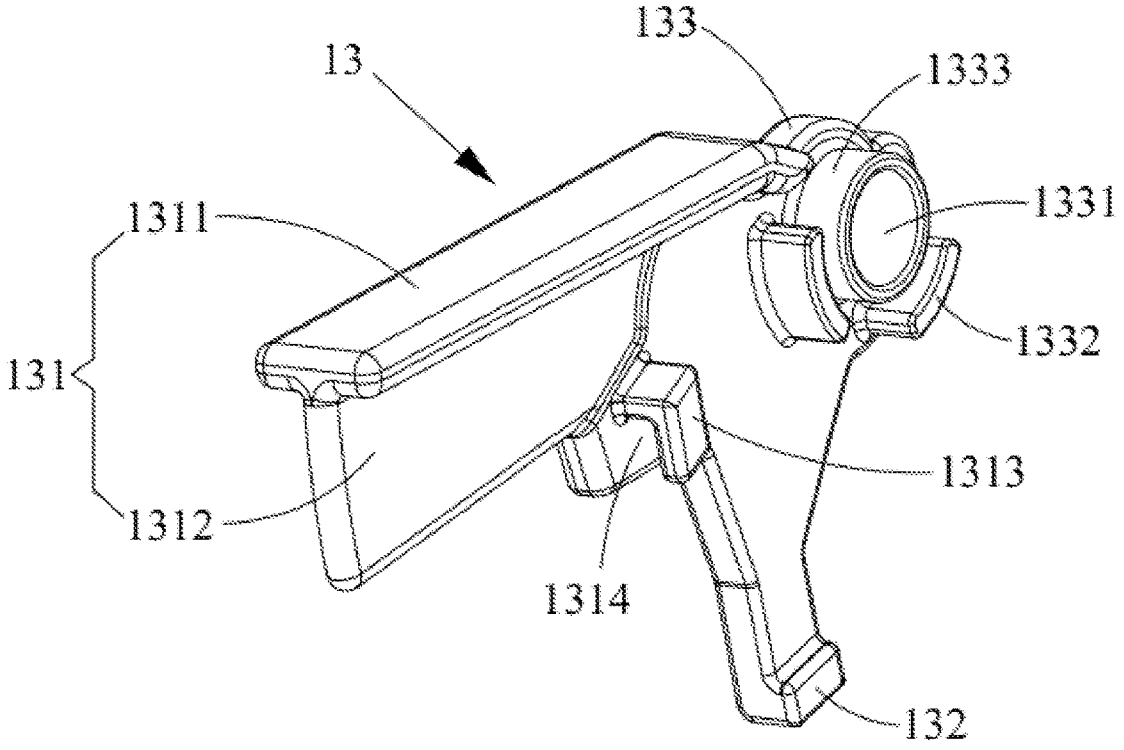
FIG. 8 is a perspective view of the locking switch in FIG. 3.
Figure 9:
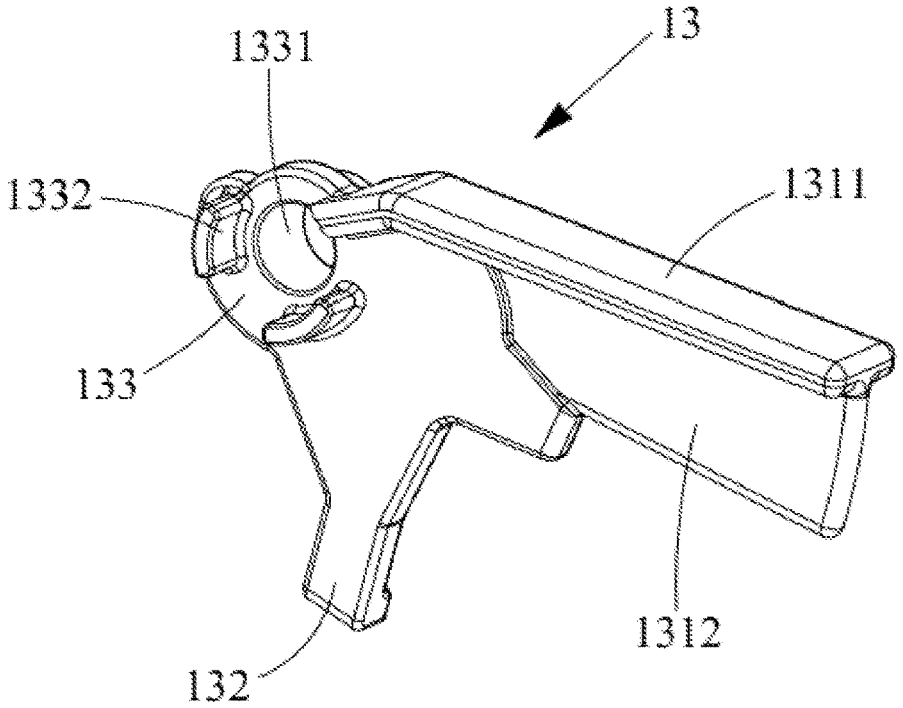
FIG. 9 is a perspective view of the locking switch shown in FIG. 8 from another angle.

As shown in FIGS. 3,6 and 7, the trigger switch 14 includes a contact portion 141 contacting the telescopic arm 122 of the main control switch 12, a holding portion 142 exposed below the housing 11, and a connection portion 143 connecting the contact portion 141 and the holding portion 142, wherein the holding portion 142 is located at a first end 140 of the trigger switch 14. The contact portion 141 is located at the second end 140' of the trigger switch 14. The connecting portion 143 is installed on the second inserting piece 118 of the second housing 112, so that the connection portion 143 can rotate relative to the housing 11, and when the holding portion 142 is grasped, the contact portion 141 can be synchronously driven to press the telescopic arm 122 of the main control switch 12 downwards to enable the main control switch 12 to be started.

The contact portion 141 is located above the telescopic arm 122 and has a smaller thickness, and the lower surface of the contact portion 141 is substantially planar, so that when the holding portion 142 is gripped, the contact portion 141 can be synchronously driven to trigger the telescopic arm 122 of the main control switch 12 downwards, and the main control switch 12 can be stably started. The connecting portion 143 is arranged in a substantially semicircular shape so as to rotate in the housing 11; the connecting portion 143 is provided with a through hole 144 for the second inserting piece 118 to pass through, the second inserting piece 118 and the through hole 144 are arranged in a circular shape, the diameter of the through hole 144 is larger than that of the second inserting piece 118, and the trigger switch 14 can conveniently rotate around the second inserting piece 118. Since the holding portion 142 needs to protrude outside the housing 11, the thickness of the holding portion 142 is larger, so that it is convenient for an operator to perform a gripping operation.

An accommodating cavity 145 is formed in the holding portion 142 of the trigger switch 14 and communicates the connecting portion 143 with the holding portion 142. The accommodating cavity 145 is arranged so that a first side wall 146 and a second side wall 147 are formed on the trigger switch 14, and the accommodating cavity 145 is positioned between the first side wall 146 and the second side wall 147; in other words, the accommodating cavity 145 is formed to be recessed downward from a top middle position of the trigger switch 14.

As shown in FIGS. 3, 5, 8 and 9, the locking switch 13 includes a pressing portion 131 exposed above the housing 11, an abutting portion 132 contacting (abutting) the trigger switch 14, and a rotating portion 133 connecting the pressing portion 131 and the abutting portion 132, the rotating portion 133 being mounted on the first inserting piece 115 of the first housing 111. The rotating portion 133 can be offset and rotated relative to the housing 11, so that the abutting portion 132 can be synchronously driven to rotate when the pressing portion 131 is pressed.

The pressing portion 131 is of a T-shaped structure and comprises a pressing plate 1311 horizontally extending in a flat plate shape and an extending plate 1312 vertically extending downwards from the middle position of the bottom of the pressing plate 1311, and the pressing plate 1311 is exposed outside the housing 11 and can be manually pressed by an operator; the extending plate 1312 is partly exposed outside the housing 11 in an initial state, and the extending plate 1312 is retracted into the housing 11 after an operator manually presses the pressing plate 1311. A fixing block 1313 is formed at the bottom of the extending plate 1312, and the fixing block 1313 is arranged in an inverted L shape to form a fixing cavity 1314 between the fixing block 1313 and the pressing portion 131.

The abutting portion 132 extends in a vertical direction for abutting the trigger switch 14 in a vertical direction. The rotating portion 133 and the abutting portion 132 are both contained in the housing 11, the rotating portion 133 is provided with a perforation hole 1331 through which the first inserting piece 115 passes, the first inserting piece 115 and the perforation hole 1331 are both circularly arranged, and the diameter of the perforation hole 1331 is larger than that of the first inserting piece 115, so that the locking switch 13 can conveniently rotate around the first inserting piece 115.

Limiting blocks 1332 are arranged on two sides of the rotating portion 133, the number of the limit block 1332 on each side can be one, two or more, and preferably, two limit blocks 1332 are arranged on each side of the rotating portion 133. The rotating portion 133 is further provided with a cylindrical sleeve 1333, the perforation hole 1331 penetrates through the sleeve 1333, and the sleeve 1333 and the fixing block 1313 are positioned on the same side of the locking switch 13.

A first elastic piece 15 and a second elastic piece 16 are further arranged in the housing 11, and the first elastic piece 15 and the second elastic piece 16 are respectively arranged on two sides of the rotating portion 133 and are used for driving the locking switch 13 to reset when the locking switch 13 is deviated and rotated. Specifically, the first elastic piece 15 is installed in the horizontal direction, one end of the first elastic piece 15 penetrates through the first inserting piece 115 and is limited and contained in a spacing cavity 117 between the first inserting piece 115 and the limiting piece 116 in a limiting way, so that the first elastic piece 15 is abutted against the inner side wall of the first housing 111; the other end of the first elastic member 15 is limited by a limiting block 1332 on the rotating portion 133 so as to be abutted against the rotating portion 133. The second elastic piece 16 is sleeved on the sleeve 1333 in the horizontal direction and limited by limiting block 1332 on the same side, one end, located in the vertical direction, of the second elastic piece 16 abuts against the inner side wall of the second housing 112, and the other end, located in the vertical direction, is limited and accommodated in the fixing cavity 1314.

By arranging the fixing block 1313, the limiting block 1332 and the sleeve 1333 on the locking switch 13, the first elastic piece 15 and the second elastic piece 16 can be limited and fixed. In the embodiment, the first elastic piece 15 is a compression spring and the second elastic piece 16 is a torsion spring, mainly used for driving the locking switch 13 to reset. Instead of the first elastic piece 15 and the second elastic piece 16, other components capable of performing the reset function as well can be used.

In this disclosure, the locking switch 13 has a locking position and a releasing position, when the locking switch 13 is in the locking position, the locking switch 13 is opposite to the trigger switch 14 and limits the action of the trigger switch 14, the trigger switch 14 is in a locked state, the main control switch 12 cannot be started, the motor cannot rotate, and the power tool cannot work normally; when the locking switch 13 is located at the releasing position, the locking switch 13 is located at the side of the trigger switch 14 and the limiting relationship between the locking switch 13 and the trigger switch 14 is released, the main control switch 12 can be started, if the trigger switch 14 is pressed at the moment, the main control switch 12 is started, the motor starts to rotate, and the power tool starts to work normally.

Figure 10:
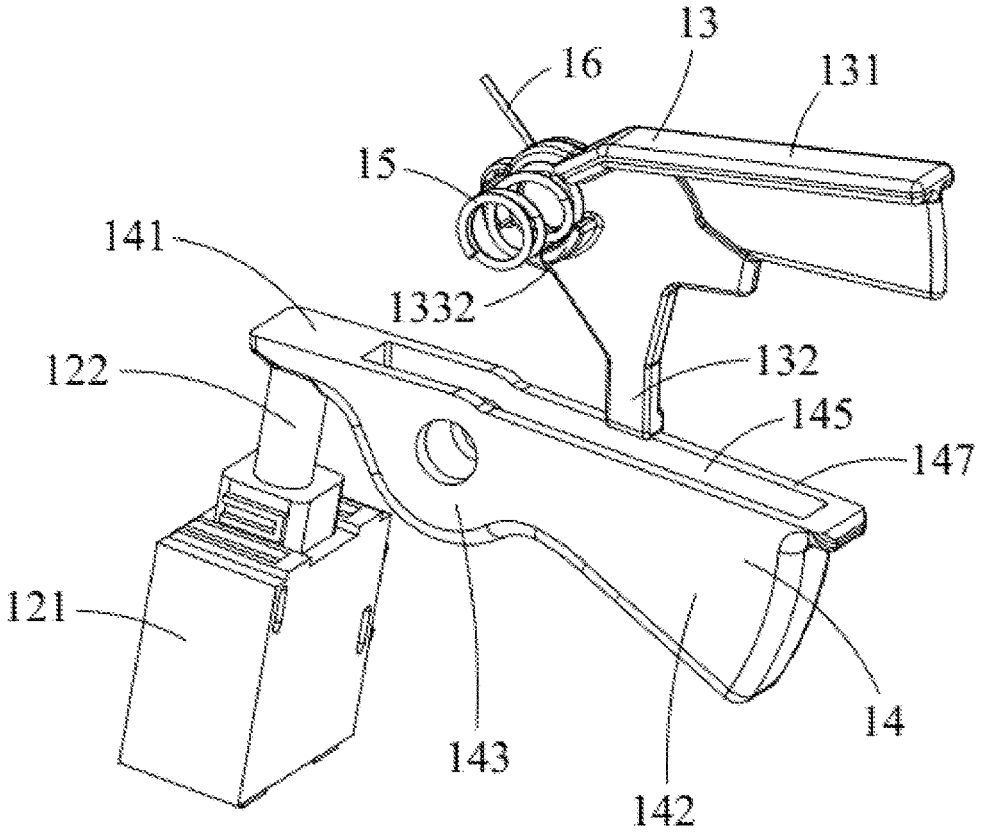
FIG. 10 is a combined structure diagram when the locking switch, trigger switch and main control switch cooperate with each other in the locked state.
Figure 11:
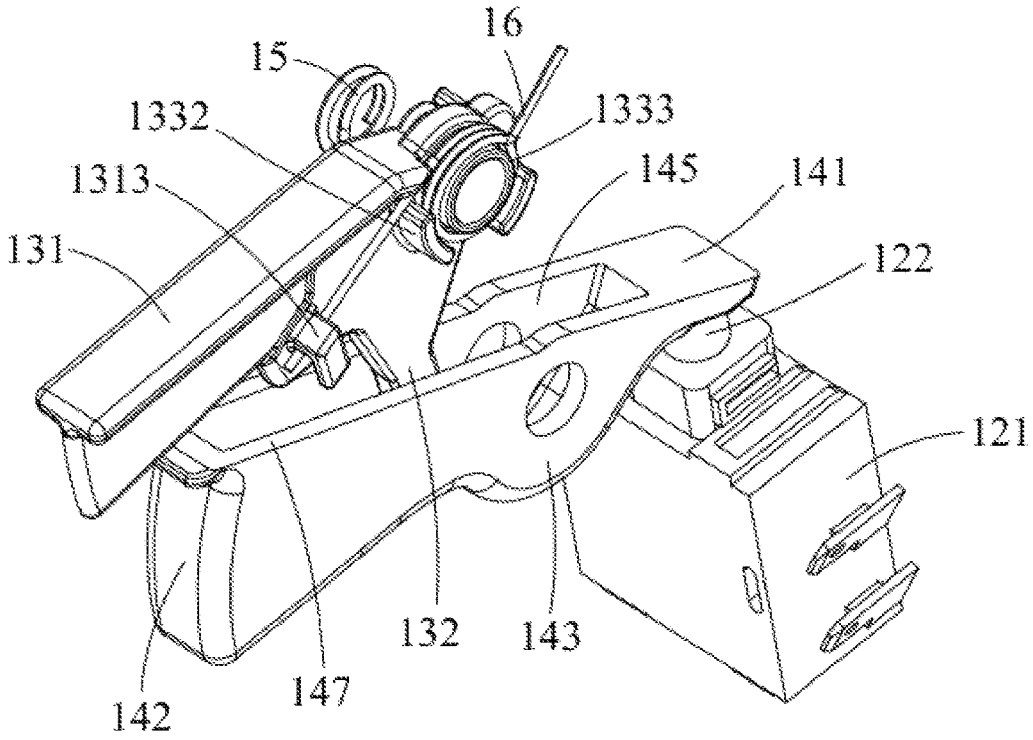
FIG. 11 is a combined structure diagram when the locking switch, trigger switch and main control switch cooperate with each other in the released state.

As shown in FIG. 10 and FIG. 11, when the locking switch 13 is in the locking position, the abutting portion 132 abuts against the top of the second side wall 147 of the holding portion 142, not only the pressing portion 131 of the locking switch 13 cannot be pressed downward, but also the holding portion 142 of the trigger switch 14 cannot be gripped upward, and the locking switch 13 and the trigger switch 14 are in a mutual locking and limiting state. When the locking switch 13 is in a releasing position, the abutting portion 132 is offset to the side of the holding portion 142, the locking switch 13 and the trigger switch 14 are released from abutting, the trigger switch 14 is in a release state, and at the moment, if the holding portion 142 is gripped, the telescopic arm 122 of the main control switch 12 can be pressed downwards through the contact portion 141 to enable the main control switch 12 to be started.

When the locking switch 13 is switched from the locking position to the releasing position, only the abutting portion 132 needs to be offset to a certain distance towards one side of the accommodating cavity 145 until the abutting portion 132 is positioned above the accommodating cavity 145, the locking state between the locking switch 13 and the trigger switch 14 is immediately released, the locking switch 13 is positioned in the releasing position, and the trigger switch 14 is in the releasing state. With regard to the first elastic piece 15 and the second elastic piece 16, when the locking switch 13 deviates towards one side of the accommodating cavity 145 (which means deviates relative to the housing 11), the first elastic piece 15 is compressed to deform, and the abutting portion 132 moves above the accommodating cavity 145; when the pressing portion 131 is pressed, the second elastic piece 16 is forcibly opened to deform, and the abutting portion 132 enters the accommodating cavity 145 and synchronously rotates in the accommodating cavity 145.

Figure 12:
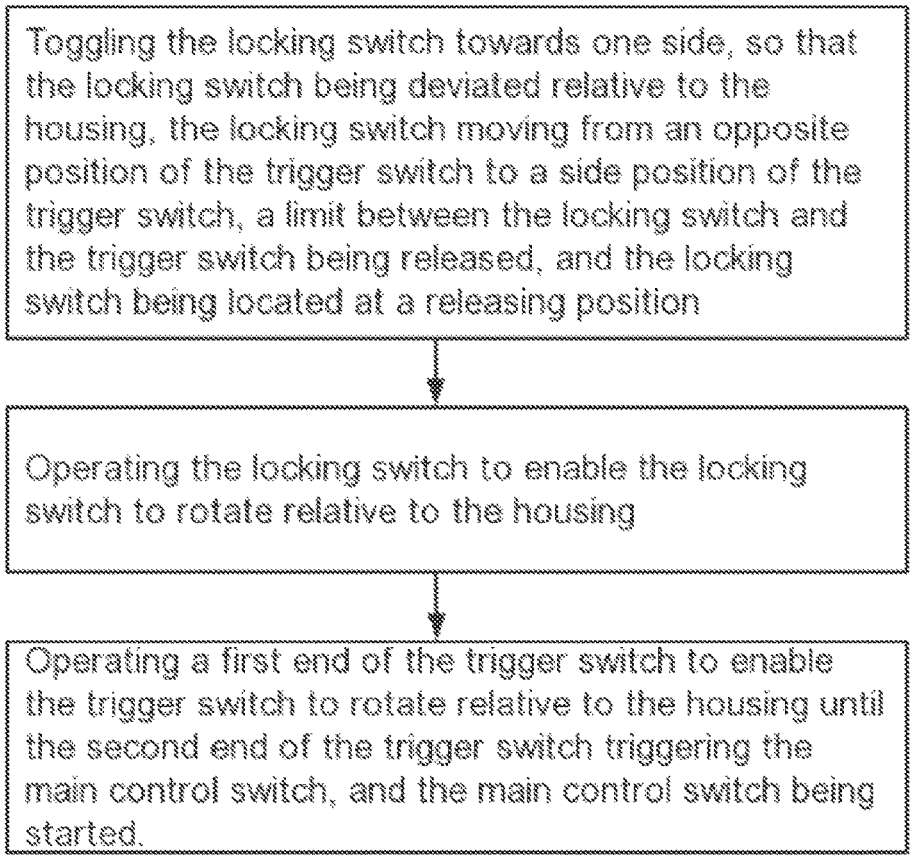
FIG. 12 is a flowchart of the method for starting the switch assembly of the disclosure.

As shown in FIG. 12, the starting method of the switch assembly 10 mainly includes the following steps:

toggling a locking switch 13 towards one side, so that the locking switch 13 deviates relative to the housing 11, the locking switch 13 moves from a relative position of the trigger switch 14 to a side position, the limit between the locking switch 13 and the trigger switch 14 is released, and the locking switch 13 is located in a releasing position;

operating (i.e. pressing down) the locking switch 13 to enable the locking switch 13 to rotate relative to the housing 11;

operating (i.e. pressing upwards) the holding portion 142 (i.e. the first end 140) of the trigger switch 14 to enable the trigger switch 14 to rotate relative to the housing 11 until the contact portion 141 (i.e. the second end 140') of the trigger switch 14 triggers the main control switch 12, and the main control switch 12 is started.

As shown in FIG. 10, when in the locked state (i.e. the initial state), the trigger switch 14 is horizontally placed, the abutting portion 132 of the locking switch 13 abuts against the top of the second side wall 147 of the holding portion 142 in the vertical direction, at this time, the pressing portion 131 of the locking switch 13 cannot be pressed downwards, the holding portion 142 of the trigger switch 14 cannot be gripped upwards, and the locking switch 13 and the trigger switch 14 are in a mutually locked state. The main switch 12 cannot be activated. In this case, even if the locking switch 13 and/or the trigger switch 14 are touched by mistake, the main control switch 12 cannot be activated, and the power tool remains in a non-use state.

When the power tool needs to be used, firstly, the whole locking switch 13 is moved towards the left side (close to one side of the accommodating cavity 145) by a certain distance, so that the abutting portion 132 of the locking switch 13 is just above the accommodating cavity 145, and at the moment, the first elastic piece 15 is compressed and deformed; then, the pressing portion 131 of the locking switch 13 is pressed downwards, the abutting portion 132 enters the accommodating cavity 145 and synchronously rotates in the accommodating cavity 145, and the second elastic piece 16 is forced to open under the action of the fixing block 1313 to deform; finally, the holding portion 142 is pressed (grasped) upward to rotate the trigger switch 14 as a whole with respect to the housing 11 until the contact portion 141 presses the telescopic arm 122 downward to start the main control switch 12 (as shown in FIG. 11), at which time the motor starts to rotate and the power tool starts to operate normally.

After use, the locking switch 13 and the trigger switch 14 are freed at the same time, and the trigger switch 14 can be restored to the initial state under the restoring force of the telescopic arm 122; meanwhile, under the action of the elastic force of the second elastic piece 16, the locking switch 13 integrally reversely rotates until the abutting portion 132 is positioned above the accommodating cavity 145 again, and then under the action of the elastic force of the first elastic piece 15, the locking switch 13 integrally deflects towards the right side (the side far away from the accommodating cavity 145) until the abutting portion 132 abuts against the top of the second side wall 147 of the trigger switch 14 again. At this time, the locking switch 13 and the trigger switch 14 are again in a mutual locking state.

In summary, in the non-use state of the switch assembly 10, the locking switch 13 can be located in the locking position and the trigger switch 14 can be in the locking state, by the mutual abutting of the trigger switch 14 and the locking switch 13, at the moment, the main control switch 12 cannot be started, and the power tool is kept in the non-use state; during normal starting, the locking switch 13 is firstly biased towards one side until the locking switch 13 and the trigger switch 14 are released from abutting, and then the main control switch 12 can be started by respectively pressing the locking switch 13 and the trigger switch 14, so that the power tool works normally. Compared with the prior art, this disclosure is not only simple in structure and convenient to operate, but also the switch assembly 10 is always in the locked state in the non-use state, and will not cause abnormal activation due to unintentional pressing, and has a higher safety factor.

Although the disclosure has been described in detail with reference to preferred embodiment, it will be understood by those skilled in the art that various changes in form and details may be made therein without deportioning from the spirit and scope of the disclosure.

What is claimed is:

1. A switch assembly comprising:

a housing;

a main control switch accommodated in the housing;

a trigger switch arranged on the housing, wherein a first end of the trigger switch is exposed outside the housing, and a second end of the trigger switch is accommodated in the housing and is in contact with the main control switch;

a first elastic piece and a second elastic piece, arranged in the housing; and a locking switch arranged on the housing, wherein a first end of the locking switch is exposed outside the housing, and a second end of the locking switch is in contact with the trigger switch, the locking switch is provided with a locking position and a releasing position, when the locking switch is in the locking position, the locking switch is opposite to the trigger switch and limits the action of the trigger switch, the trigger switch is in a locked state, and the main control switch cannot be started, and when the locking switch is located at the releasing position, the locking switch is located beside the trigger switch and limits are removed, the trigger switch is in a release state, and the main control switch can be started, the locking switch comprises a rotating portion and an abutting portion, the rotating portion is configured to be offset relative to the housing in the left and right direction of the rotating portion and rotated relative to the housing so that the abutting portion is synchronously driven to rotate for the trigger switch to be unlocked, the first elastic piece and the second elastic piece are respectively arranged on left and right sides of the rotating portion, the first elastic piece is used for driving the locking switch to reset when the locking switch is offset relative to the housing and the second elastic piece is used for driving the locking switch to reset when the locking switch is rotated.

2. The switch assembly according to claim 1, wherein the trigger switch comprises a contact portion contacted with the main control switch and a holding portion exposed outside the housing, the locking switch comprises a pressing portion exposed outside the housing and the abutting portion contacted with the trigger switch, when the locking switch is in the locking position, the abutting portion abuts against an inner side wall of the holding portion, and when the locking switch is located at the releasing position, the abutting portion is shifted to a side of the holding portion and is released from abutting, and after the holding portion is operated, the contact portion triggers the main control switch, so that the main control switch is started.

3. The switch assembly according to claim 2, wherein the holding portion is internally provided with an accommodating cavity, in the locking state, the abutting portion is in contact with a top wall of the holding portion, and in the releasing state, the abutting portion is positioned above the accommodating cavity.

4. The switch assembly according to claim 3, wherein the rotating portion connecting the pressing portion and the abutting portion, and the rotating portion is mounted on the housing and is configured to be offset towards a side of the housing, then the pressing portion is pressable, and the rotating portion is configured to be rotatable relative to the housing, and when the pressing portion is pressed, the abutting portion synchronously rotates.

5. The switch assembly according to claim 4, wherein the housing comprises a first housing and a second housing, wherein a first end of the first elastic piece is abutted against an inner side wall of the first housing, a second end of the first elastic piece is abutted against the rotating portion, when the locking switch deviates relative to the housing, the first elastic piece deforms, and the abutting portion moves to the accommodating cavity, and the second elastic piece is sleeved on the rotating portion, a first end of the second elastic piece is abutted against the inner side wall of the second housing, a second end of the second elastic piece is fixed with the pressing portion, when the pressing portion is pressed, the second elastic piece deforms, and the abutting portion enters the accommodating cavity and synchronously rotates in the accommodating cavity.

6. The switch assembly according to claim 5, wherein limiting blocks to limit and fix the first elastic piece and the second elastic piece are arranged on two sides of the rotating portion, a fixing block are formed on the pressing portion, and the fixing block is arranged in an inverted L shape to form a fixing cavity between the fixing block and the pressing portion, and the other end of the second elastic piece is limited and accommodated in the fixing cavity.

7. The switch assembly according to claim 2, wherein the trigger switch further comprises a connecting portion to connect the contact portion and the holding portion, wherein the connecting portion is installed on the housing and can rotate relative to the housing, so that when the holding portion is operated, the contact portion is synchronously driven to trigger the main control switch, and the main control switch is started.

8. The switch assembly according to claim 7, wherein the main control switch is arranged in a pressing mode and comprises a body portion and a telescopic arm connected with the body portion, and the contact portion of the trigger switch is positioned above the telescopic arm so as to start the main control switch when the contact portion presses the telescopic arm downwards.

9. A method of activating a switch assembly, wherein the switch assembly including:

a housing;

a main control switch accommodated in the housing;

a trigger switch arranged on the housing, wherein a first end of the trigger switch is exposed outside the housing, and a second end of the trigger switch is accommodated in the housing and is in contact with the main control switch;

a first elastic piece and a second elastic piece, arranged in the housing; and a locking switch arranged on the housing, wherein a first end of the locking switch is exposed outside the housing, and a second end of the locking switch is in contact with the trigger switch, the locking switch is provided with a locking position and a releasing position, when the locking switch is in the locking position, the locking switch is opposite to the trigger switch and limits the action of the trigger switch, the trigger switch is in a locked state, and the main control switch cannot be started, and when the locking switch is located at the releasing position, the locking switch is located beside the trigger switch and limits are removed, the trigger switch is in a release state, and the main control switch can be started, the locking switch comprises a rotating portion and an abutting portion, the rotating portion is configured to be offset relative to the housing in the left and right direction of the rotating portion and rotated relative to the housing so that the abutting portion is synchronously driven to rotate for the trigger switch to be unlocked, the first elastic piece and the second elastic piece are respectively arranged on left and right sides of the rotating portion, the first elastic piece is used for driving the locking switch to reset when the locking switch is offset relative to the housing and the second elastic piece is used for driving the locking switch to reset when the locking switch is rotated; and the method comprising:

toggling the locking switch towards one side, so that the locking switch being deviated relative to the housing, the locking switch moving from an opposite position of the trigger switch to a side position of the trigger switch, a limit between the locking switch and the trigger switch being released, and the locking switch being located at a releasing position;

operating the locking switch to enable the locking switch to rotate relative to the housing; and operating a first end of the trigger switch to enable the trigger switch to rotate relative to the housing until the second end of the trigger switch triggering the main control switch, and the main control switch being started.

10. The method according to the claim 9, wherein when the locking switch and trigger switch are freed, the locking switch and the trigger switch are in locking position again, the main control switch cannot be started.

11. The method according to the claim 10, the locking switch and the trigger switch are in a mutual locking state after freeing the locking switch and trigger switch.

12. A power tool, comprising a motor; and a switch assembly to control activation or deactivation of the motor, wherein the switch assembly comprises:

a housing;

a main control switch accommodated in the housing;

a trigger switch arranged on the housing, wherein a first end of the trigger switch is exposed outside the housing, and a second end of the trigger switch is accommodated in the housing and is in contact with the main control switch;

a first elastic piece and a second elastic piece, arranged in the housing; and a locking switch arranged on the housing, wherein a first end of the locking switch is exposed outside the housing, and a second end of the locking switch is in contact with the trigger switch, the locking switch is provided with a locking position and a releasing position, when the locking switch is in the locking position, the locking switch is opposite to the trigger switch and limits the action of the trigger switch, the trigger switch is in a locked state, and the main control switch cannot be started, and when the locking switch is located at the releasing position, the locking switch is located beside the trigger switch and limits are removed, the trigger switch is in a release state, and the main control switch can be started, the locking switch comprises a rotating portion and an abutting portion, the rotating portion is configured to be offset relative to the housing in the left and right direction of the rotating portion and rotated relative to the housing so that the abutting portion is synchronously driven to rotate for the trigger switch to be unlocked, the first elastic piece and the second elastic piece are respectively arranged on left and right sides of the rotating portion, the first elastic piece is used for driving the locking switch to reset when the locking switch is offset relative to the housing and the second elastic piece is used for driving the locking switch to reset when the locking switch is rotated.

13. The power tool according to claim 12, wherein the trigger switch comprises a contact portion contacted with the main control switch and a holding portion exposed outside the housing, the locking switch comprises a pressing portion exposed outside the housing and an abutting portion contacted with the trigger switch, when the locking switch is in the locking position, the abutting portion abuts against an inner side wall of the holding portion, and when the locking switch is located at the releasing position, the abutting portion is shifted to a side of the holding portion and is released from abutting, and after the holding portion is operated, the contact portion triggers the main control switch, so that the main control switch is started.

14. The power tool according to claim 13, wherein the holding portion is internally provided with an accommodating cavity, in the locking state, the abutting portion is in contact with a top wall of the holding portion, and in the releasing state, the abutting portion is positioned above the accommodating cavity.

* * * * *